US007626131B1

(12) United States Patent
Gibboney, Jr.

(10) Patent No.: US 7,626,131 B1
(45) Date of Patent: Dec. 1, 2009

(54) MECHANICAL SHUNT FOR LIGHT STRING SOCKET WITH SELF-CLEANING FEATURE

(75) Inventor: James W. Gibboney, Jr., Conyers, GA (US)

(73) Assignee: Tech Patent Licensing, LLC, St. Augustine, FL (US)

( * ) Notice: Subject to any disclaimer, the term of this patent is extended or adjusted under 35 U.S.C. 154(b) by 0 days.

(21) Appl. No.: 12/421,138

(22) Filed: Apr. 9, 2009

Related U.S. Application Data

(60) Provisional application No. 61/058,248, filed on Jun. 3, 2008.

(51) Int. Cl.
*H01R 33/96* (2006.01)

(52) U.S. Cl. ..... 200/51.1; 439/188; 315/122; 200/242

(58) Field of Classification Search ..... 200/51.1, 200/51.09, 51 R, 241, 242; 439/188, 513, 439/699.2, 619; 315/122, 119
See application file for complete search history.

(56) References Cited

U.S. PATENT DOCUMENTS

| | | | | |
|---|---|---|---|---|
| 348,875 | A | | 9/1886 | Wightman et al. |
| 975,090 | A | | 11/1910 | Wappler |
| 3,345,482 | A | | 10/1967 | Lou |
| 3,359,523 | A | | 12/1967 | Lou |
| 4,233,543 | A | | 11/1980 | Hickok |
| 4,350,407 | A | | 9/1982 | Tong |
| 4,539,444 | A | * | 9/1985 | Senoh ..... 200/242 |
| 4,654,766 | A | | 3/1987 | Tung |
| 4,739,127 | A | | 4/1988 | Higuchi et al. |
| 4,991,071 | A | | 2/1991 | Braasch |
| 6,533,437 | B1 | | 3/2003 | Ahroni |
| 6,583,536 | B1 | | 6/2003 | Gibboney |
| 6,609,814 | B2 | | 8/2003 | Ahroni |
| 7,186,017 | B2 | | 3/2007 | Kuo |
| 7,264,392 | B2 | | 9/2007 | Massabki et al. |
| 7,453,194 | B1 | | 11/2008 | Gibboney |
| 7,473,024 | B2 | | 1/2009 | Gibboney |
| 7,484,995 | B2 | | 2/2009 | Ding |
| 2003/0156412 | A1 | | 8/2003 | Limber et al. |
| 2003/0214212 | A1 | | 11/2003 | Gibboney, Jr. |
| 2007/0297196 | A1 | | 12/2007 | Massabki et al. |

* cited by examiner

*Primary Examiner*—Felix O Figueroa
(74) *Attorney, Agent, or Firm*—Michael A. Mann; Nexsen Pruet, LLC

(57) ABSTRACT

A mechanical shunt for use in a socket of a string of lights resides in an otherwise typical lamp of a string of lights. The present shunt is a pair of cantilevered portions from the electrical terminals inside the socket of a lamp in a string of lights. The portions touch and conduct electrical current when no lamp holder is in the socket but are separated by a button on the bottom of the lamp holder when the lamp holder is not in the socket. The cantilevered portions are formed in such a way that they rub together when opening, closing or when the socket undergoes expansion and contraction with changing temperature in order to prevent the buildup of corrosion on the teeth on the end of the cantilevered portion that would preclude their ability to make good electrical contact when needed.

5 Claims, 4 Drawing Sheets

MECHANICAL SHUNT FOR LIGHT STRING SOCKET WITH SELF-CLEANING FEATURE

CROSS REFERENCE TO RELATED PATENTS

The priority benefit of U.S. provisional patent application Ser. No. 61/058,248 filed Jun. 3, 2008, which is incorporated herein by reference, is claimed.

BACKGROUND OF THE INVENTION

The present invention relates to light strings such as are used for holiday lighting, and in particular to mechanical shunts for passing electrical current to the next light in the string if a bulb is loose or missing.

Strings of lights are typically wired electrically in series. Consequently, when one light in the string burns out or is removed, all the lights in the string go out. Determining which light needs to be replaced is somewhat tedious. If the string has 50 or more lights and the string is attached to a Christmas tree, finding the burned out or missing bulb can be very tedious.

For a number of years, this problem has been solved, or at least avoided, by the use of shunts that allow current to pass directly between the terminals of the defective lamp, bypassing the missing or defective bulb filament. Passing electrical current from one lamp to the next regardless of the condition of the bulb in any individual lamp allows the remaining lamps to continue to operate.

Shunts are typically found in two places in prior art lamps, namely, in the glass bulb and in the socket. The shunts inside the glass bulb are typically coils of wire wrapped around the conductive elements (called Dumet wires). When the filament fails, the oxide coating on the wires that theretofore prevented direct conduction of electricity is burned off and the coil welds itself to the Dumet wires, thereby providing a new electrically conductive path for passing the electrical current.

Of the shunts that are located in the socket, there are two types, namely, solid state shunts and mechanical shunts. Among the mechanical shunts, for example, there is a set of spring contact terminals that is the subject of U.S. Pat. No. 6,257,740. These spring contacts are pushed apart when the lamp base is inserted into the socket and spring back together when the base is removed, thereby allowing the current to pass from one terminal to the other directly. This type is strictly for use when the bulb (and its base) is removed and does not address the issue of a burned out bulb. This type of shunt works well and has enjoyed commercial success.

Another mechanical shunt is disclosed in U.S. Pat. No. 7,253,556, which is invented by one of the present inventors and is commonly owned by applicant. This mechanical shunt is a nearly horizontal flat strip of metal held in place between the two electrical terminals in a light socket by a shunt holder. The ends of the shunt extend laterally and slightly downwardly to engage the electrical terminals mounted to the socket wall. When the lamp base, which is hollow, is inserted into the socket, the shunt holder together with its shunt is received inside the hollow base, and, as the shunt enters the base, its lateral ends are bent down and away from the electrical terminals on the socket wall, thereby allowing electrical current to pass to and through the Dumet wires and thence to the filament in the bulb rather than directly through the shunt between the electrical terminals.

U.S. Pat. No. 6,609,814 issued to Ahroni teaches a mechanical shunt composed of two portions. The two portions of the shunt are nearly co-planar and in electric contact with each other and the electrical terminals mounted on the wall of his socket. When the bulb holder is inserted into a socket, a first of the two portions is pressed down, out of engagement and electrical connection with the second of the two portions. When the bulb holder is removed from the socket, the first portion resiliently resumes electrical contact with the second portion.

One problem with miniature lamps is the corrosion of electrical conductors. There are two main contributors to corrosion in lamps. The first is the intrusion of moisture from the environment. The second is the release of gases from the plastic, which gases accelerate the process of natural corrosion. The build up of corrosion quickly renders electrical conductors non-conductive. In a mechanical shunt, a corroded shunt will cause a light string failure as surely as the lack of a shunt.

There are a huge number of light strings manufactured and sold each year throughout the world. The number is so large that even small changes that, for example, reduce material requirements, simplify manufacturing, or improve safety or reliability, make a huge difference in the costs to manufacture. Accordingly, there remains a need for a better mechanical shunt for use in the sockets of the lamps of light strings.

SUMMARY OF THE INVENTION

According to its major aspects and briefly recited, the present invention is a mechanical shunt switch for use in the sockets of a string of lights. The switch redirects the current flow from passing through the filament to passing directly to the next light in the string of lights when the lamp is removed from the socket.

The present shunt switch is found in an otherwise typical-looking socket of a string of lights having plural lamps electrically interconnected in series by insulated, conductive wires. Each lamp has a bulb and a bulb holder, each bulb having a coiled filament inside running between a pair of terminal wires. These terminal wires, called Dumet wires, extend from the inside of the bulb through a slot, a hole, or two spaced-apart holes formed in the bulb holder. Once they emerge from the bulb holder, the Dumet wires are bent back against the outside of the bulb holder. The bulb holder may be removably seatable into a lamp socket that has two modified electrical terminals mounted opposite each other on the interior of the socket wall. The shunt is comprised of cantilevered portions of the electrical terminals, which extend toward one another and touch. One cantilevered portion is longer than the other and extends just past the middle of the socket so that, when the bulb holder is properly inserted, the bottom of the holder, which can be equipped with a button, depresses the longer portion thus separating it from the shorter and allowing current to flow to the Dumet wires and filament.

One advantage of the present invention is that the shunt is self-cleaning at the point of contact. Because corrosion is a real problem in light strings, particularly those used out of doors, this feature improves the durability of the present light strings over prior art, non-self-cleaning shunts for light strings. Importantly, the touching ends of the two cantilevered portions do no simply touch (as in the patent to Ahroni). The cantilevered portions are formed so that they rub against one another when they make contact and when contact is broken, which helps to keep them clean and free of corrosion.

Another important feature of the present shunt is that unlike other prior art shunts, the shunt of the present invention is attached to or integral to the electrical terminals on the inside of the socket and, therefore, does not require the manufacture or installation of a shunt holder. Accordingly, the present shunt system requires less material and no special installation steps compared to prior art shunts.

These and other features and their advantages will be apparent to those skilled in the art of light string electrical design from a careful reading of the Detailed Description of Embodiments accompanied by the following drawings.

DETAILED DESCRIPTION OF THE INVENTION

The present invention is a lamp with a mechanical shunt for use in a string of lights. The shunt can be opened and closed and shifts the flow of electrical current from a first path leading from electrical terminals mounted on the inside wall of the lamp socket through a filament in the bulb to a second path that bypasses the filament directing the current through the shunt from one terminal to the next. The path the current is permitted to take (i.e. whether the shunt is opened or closed) depends on whether the bulb holder is present in the socket or not. The term "lamp" refers to a bulb, bulb holder, Dumet wires, and a filament. The term "light" refers to a lamp along with a socket, shunt, electrical terminals, and insulated wires supplying power to the lamp. The term "light string" refers to plural spaced-apart lights connected in series by insulated wires.

Figure 1:
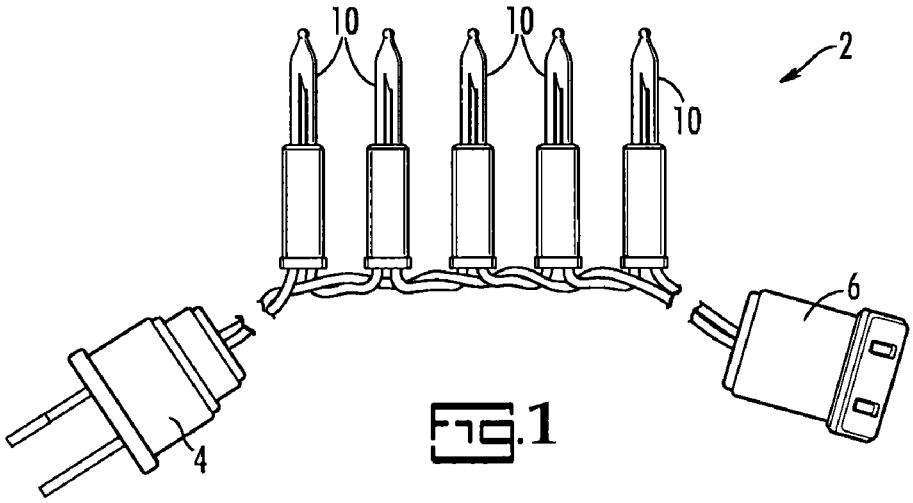
FIG. 1 is a abbreviated side view of an typical string of lights.
Figure 2:
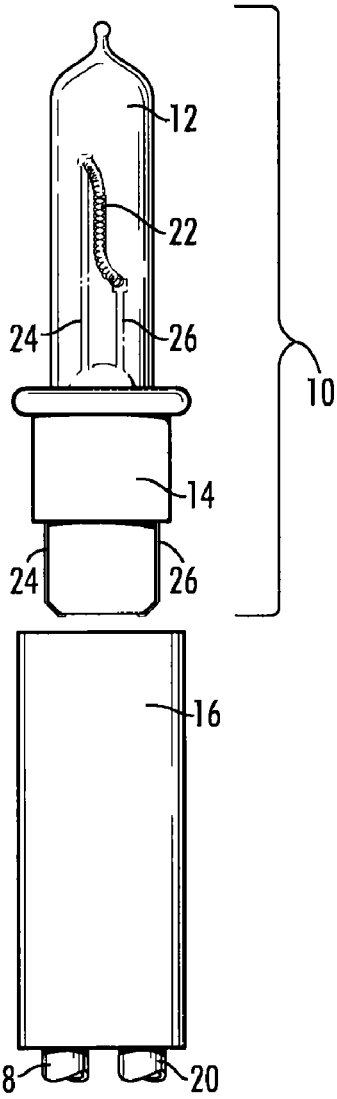
FIG. 2 is an exploded side view of a single lamp and socket from the light string shown in FIG. 1.

FIG. 1 shows an abbreviated string of lights 2 with five lamps 10 joined in series with a plug 4 at one end and a receptacle 6 at the other end. FIG. 2 illustrates a lamp 10 and socket 16, in a side view. Lamp 10 includes a bulb 12, a bulb holder 14, Dumet wires 24 and 26, and filament 22. Bulb 12 is a partially-evacuated transparent glass housing. Lamp 10 is removably seatable in socket 16. Two insulated electrical wires, first insulated wire 18 and second insulated wire 20, extend from socket 16 and are connected to the adjacent sockets in the series of sockets of the light string or the connectors 4 and 6 at the ends of the light string 2 (FIG. 1). Dumet wires 24 and 26 extend from the interior of bulb 12 to the exterior of bulb holder 14 through at least one hole in bulb holder 14.

Figure 3A:
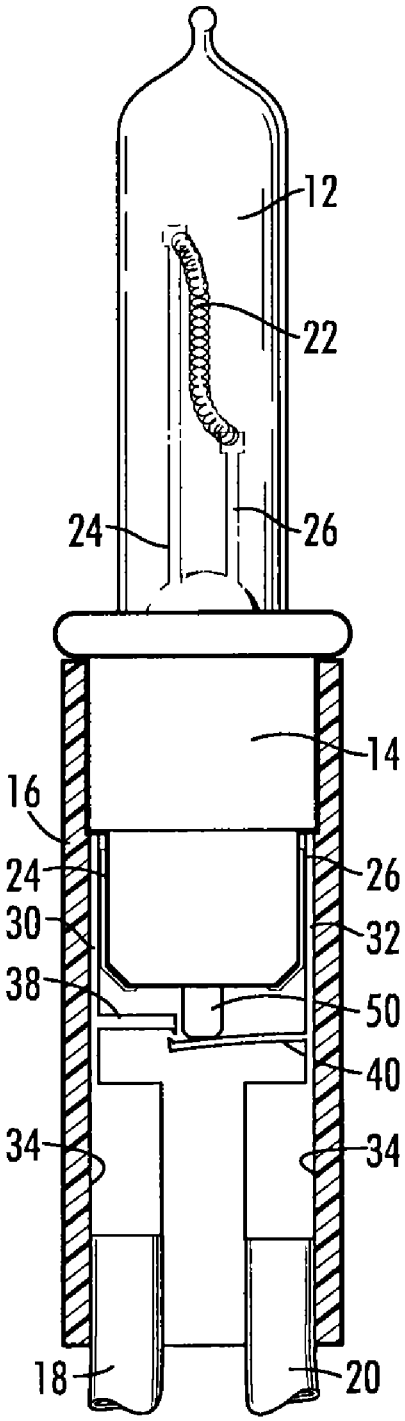
FIG. 3A is a cross-sectional view of the socket according to one embodiment of the present invention with the lamp shown inserted into the socket and the bulb holder depressing one of the cantilevered portions thereby opening the shunt.
Figure 3B:
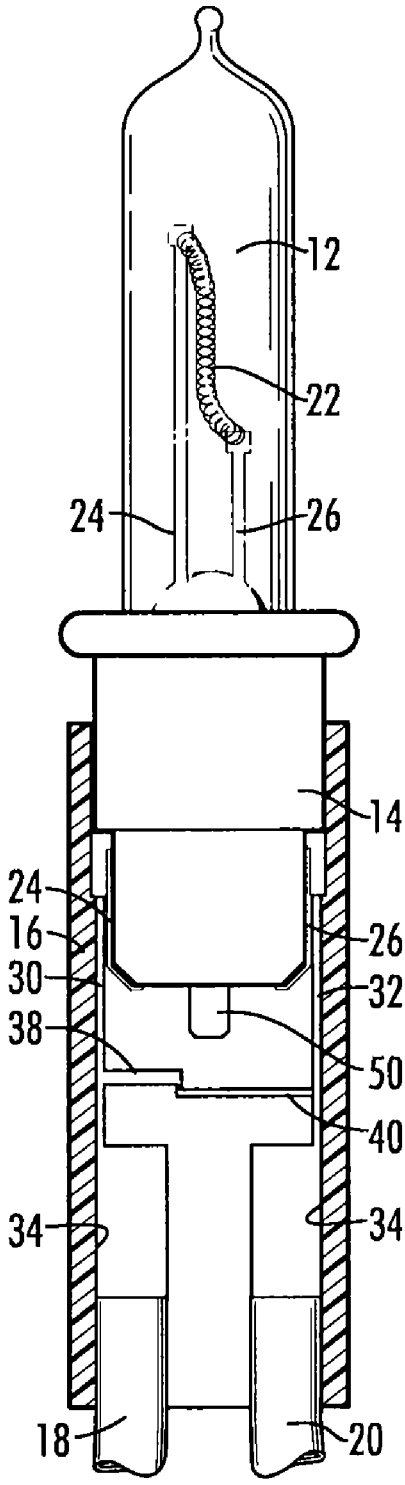
FIG. 3B is a cross-sectional view of the socket according to one embodiment of the present invention with the lamp shown partially removed from the socket allowing the cantilevered portions to resume contact.

FIGS. 3A and 3B are both cross-sectional views of a lamp 10 (FIG. 2) in a socket 16 according to one embodiment of the present invention. It can be seen in both FIGS. 3A and 3B that Dumet wires 24 and 26, after exiting the bottom of bulb holder 14, are folded back against the sides of bulb holder 14 in order to be in a position to make contact with a first and opposing second electrical terminals 30 and 32 on the interior wall 34 of socket 16. FIG. 3A shows a lamp 10 according to one embodiment of the present invention with the bulb holder 14 fully seated in socket 16 and with electrical current flowing to the filament 22, as further explained below. FIG. 3B, in contrast, shows the lamp 10 of the present invention with bulb holder 14 partially removed from socket 16 and with electrical current flowing through a shunt comprised of cantilevered portions 38 and 40.

Figure 4A:
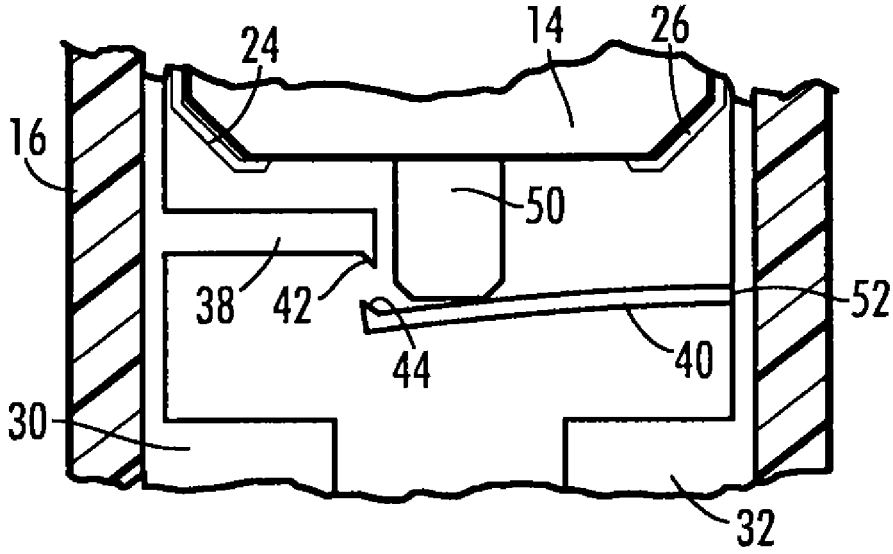
FIG. 4A is a detail taken from FIG. 3A showing the bulb holder depressing one of the cantilevered portions thereby opening the shunt, according to one embodiment of the invention.
Figure 4B:
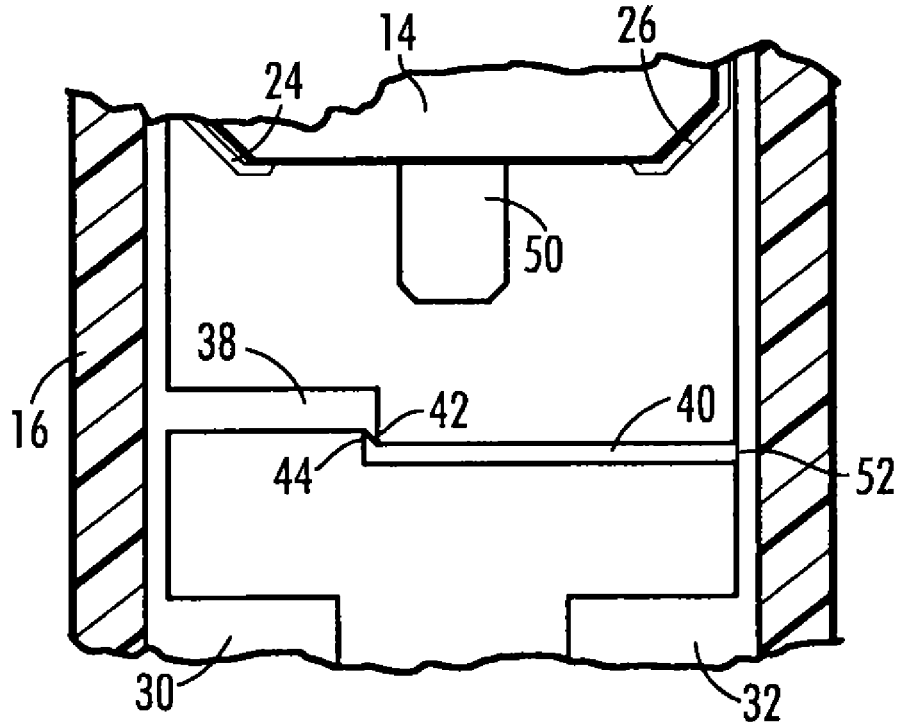
FIG. 4B is a detail taken from FIG. 3B showing the bulb holder partially removed from the socket allowing the cantilevered portions to resume contact, according to one embodiment of the invention.

FIGS. 4A and 4B, which are details of FIGS. 3A and 3B, show that first and opposing second cantilevered portions 38 and 40 extend toward one another from first and second terminals 30 and 32. In this particular embodiment of the present invention, first cantilevered portion 38 extends approximately ⅓ of the way across the interior of socket 16 and has at its distal end a first downward-depending tooth 42. Second cantilevered portion 40 extends toward first cantilevered portion 38, but lies in a plane slightly below that of the plane of first cantilevered portion 38. Second cantilevered portion 40 has at its distal end a second upward-depending tooth 44. The first cantilevered portion has a first thickness and the second cantilevered portion has a second thickness and the first thickness is greater than the second thickness.

Referring now to FIG. 4A, when bulb holder 14 is seated in socket 16, a button 50 formed on the bottom of lamp holder 14 engages second cantilevered portion 40 and depresses it, disengaging second cantilevered portion 40 from first cantilevered portion 38, resulting in an open shunt and no passing of current from first to second cantilevered portions 38 and 40. When the shunt is open as in FIG. 4A, current is instead passed through Dumet wires 24 and 26 and thence through filament 22. As seen in FIG. 4B, when lamp holder 14 is removed from socket 16, second cantilevered portion 40 resiliently resumes electrical contact with first cantilevered portion 38, thereby allowing current to flow through the shunt rather than through filament 22. Importantly, second tooth 44 rubs against first tooth 42 whenever the first and second cantilevered portions 38 and 40 are separated or rejoined.

Figure 5A:
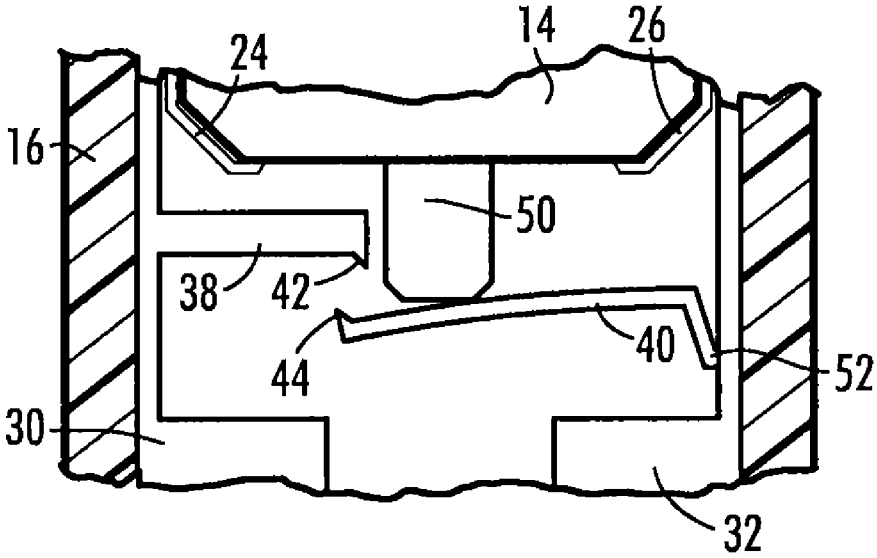
FIG. 5A is a close-up view of the bulb holder seated in the socket and depressing a cantilevered portion having an offset hinge, according to another embodiment of the present invention.
Figure 5B:
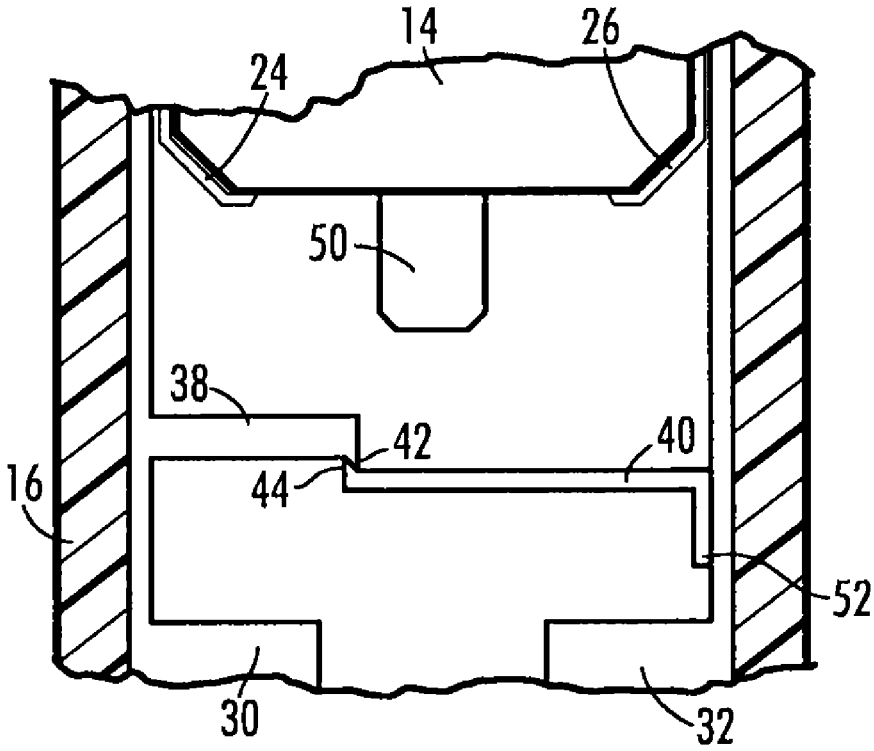
FIG. 5B is a close-up view of the bulb holder partially removed from the socket allowing the cantilevered portions, one of which has an offset hinge, to resume contact, according tot another embodiment of the present invention.

The self-cleaning action between tooth 42 and tooth 44 is caused, at least in part, by the structure of second cantilevered portion 40 and, in particular, how it moves with respect to the balance of second terminal 34 and first cantilevered portion 38. First cantilevered portion 38 is rigidly, and preferably integrally, attached to first electrical terminal 32. Second cantilevered portion 40, which is longer and can be thinner and therefore springier than first cantilevered portion 38, can also be integrally formed as part of second electrical terminal 34. Second cantilevered portion 40 can also be thicker near the hinge point but thinner toward tooth 44. Second cantilevered portion 40 can also be structured so that the hinge point 52, that is, where it connects to the balance of second terminal 34, is below first cantilevered portion 38. This allows tooth 44 to have a significant lateral component (in addition to the arcuate component) to its motion as it approaches and cams against first tooth 42. This creates a wiping action as second cantilevered portion 40 loses contact with or regains contact with first cantilevered portion 38. The hinge point 52 can be further lowered with the use of an offset hinge, allowing even greater lateral movement of second tooth 44. FIGS. 5A and 5B show another embodiment of the present invention wherein second cantilevered portion 40 has an offset hinge.

The structure and orientation of teeth 42 and 44, namely their having opposed and parallel angled surfaces designed to rub against one another, also can increase the surface area contact and rubbing between first cantilevered portion 38 and second cantilevered portion 40. Furthermore, expansion and contraction of socket 16 due to, for example, exposure to the temperature fluctuations of day and night, force continued cleaning action as the two angled surfaces of first tooth 42 and second tooth 44 rub against each other.

It is also important to prevent arcing when lamp holder 14 is removed from socket 16. Arcing is avoided by selection of the geometric relationships among the specific location of first and second cantilevered portions 38 and 40, with respect to the balance of first and second electrical terminals 32 and 34, the location and length of button 50 on bulb holder 14, and the location of first and second Dumet wires 24 and 26. The dimensions that define this geometric relationship must ensure that, when the bulb holder 14 is being inserted in the socket 16, first and second Dumet wires 24 and 26 contact first and second electrical terminals 32 and 34 before first and second cantilevered portions 38 and 40 are separated by button 50. Likewise, the dimensions must ensure that when bulb holder 14 is seated into socket 16, first and second Dumet wires 24 and 26 remain in contact with first and second electrical terminals 32 and 34 until just after first and second cantilevered portions 38 and 40 resume contact.

It is intended that the scope of the present invention include all modifications that incorporate its principal design features, and that the scope and limitations of the present invention are to be determined by the scope of the appended claims and their equivalents. It also should be understood, therefore, that the inventive concepts herein described are interchangeable and/or they can be used together in still other permutations of the present invention, and that other modifications and substitutions will be apparent to those skilled in the art from the foregoing description of the preferred embodiments without departing from the spirit or scope of the present invention.

What is claimed is:

1. A light for use in a light string, said light comprising:

a bulb;

a filament in said bulb;

a bulb holder carrying said bulb, said bulb holder having at least one hole therein and a button depending therefrom;

a first and a second Dumet wire extending from said filament inside said bulb through said at least one hole in said bulb holder to the exterior of said bulb holder;

a socket carrying said bulb holder, said bulb holder removably seatable in said socket, said socket having an interior wall;

a first and an opposing second electrical terminal carried by said interior wall of said socket, said first and second Dumet wires engaging said first and second electrical terminals, respectively, when said bulb holder is seated in said socket, a shunt, said shunt having a first cantilevered portion extending from said first electrical terminal partially across said socket, said first cantilevered portion having a first distal end, said first distal end having a first tooth depending therefrom;

a second cantilevered portion extending from said second electrical terminal across said socket toward said first cantilevered portion, said second cantilevered portion having a second distal end, said second distal end having a second tooth depending therefrom, said first and second cantilevered portions being dimensioned so that, when said bulb holder is removed from said socket, said first and second teeth rub against each other and said first and second cantilevered portions are in electrical contact whereby electrical current flows from said first electrical terminal to said second electrical terminal through said shunt, and, when said bulb holder is inserted into said socket, said first and second teeth rub against each other and said bulb holder moves said second cantilevered portion away from said first cantilevered portion so that said first and second cantilevered portions lose electrical contact whereby electrical current flows from said first and second electrical terminals through said first and second Dumet wires and thence through said filament wherein said first cantilevered portion has a first thickness and said second cantilevered portion has a second thickness and wherein said first thickness is greater than said second thickness;

wherein said second cantilevered portion is attached to said second electrical terminal so that, when said second cantilevered portion pivots toward or away from said first cantilevered portion, said first and second teeth are urged against each other thereby cleaning said first and second teeth for better electrical contact; and wherein said second cantilevered portion is attached to said second electrical terminal by an offset hinge permitting lateral movement of said second tooth in addition to arcuate movement, said offset hinge permitting said second tooth to cam against said first tooth.

2. The light as recited in claim 1, wherein said first cantilevered portion has a first length and said second cantilevered portion has a second length and wherein said first length is smaller than said second length.

3. The light as recited in claim 1, wherein said first and second teeth are formed so that thermal expansion and contraction of said socket causes said first and second teeth to rub together.

4. The light as recited in claim 1, wherein said button is dimensioned so that, as said bulb holder is inserted into said socket, said first and second Dumet wires contact said first and second terminals before said button opens said shunt, and, as said bulb holder is removed from said socket, said button closes said shunt before said first and second Dumet wires lose contact with said first and second terminals.

5. A light string, said light string comprising:

a plurality of lamps, said each of said plurality of lamps having a bulb;

a filament in said bulb;

a bulb holder carrying said bulb, said bulb holder having at least one hole therein and a button depending therefrom; and a first and a second Dumet wire extending from said filament inside said bulb through said at least one hole in said bulb holder to the exterior of said bulb holder;

a plurality of sockets arranged in an electrical series and connected by electrical conductors, said plurality of lamps being removably seatable in said plurality of sockets, each socket of said plurality of sockets having an interior wall and having a first and an opposing second electrical terminal carried by said interior wall of said each socket, said first and second Dumet wires engaging said first and second electrical terminals, respectively, when said bulb holder is seated in said each socket; and a shunt, said shunt having a first cantilevered portion extending from said first electrical terminal partially across said socket, said first cantilevered portion having a first distal end, said first distal end having a first tooth depending therefrom;

a second cantilevered portion extending from said second electrical terminal across said socket toward said first cantilevered portion, said second cantilevered portion having a second distal end, said second distal end having a second tooth depending therefrom, said first and second cantilevered portions being dimensioned so that, when said bulb holder is removed from said socket, said first and second teeth rub against each other and said first and second cantilevered portions are in electrical contact whereby electrical current flows from said first electrical terminal to said second electrical terminal through said shunt, and, when said bulb holder is inserted into said socket, said first and second teeth rub against each other and said bulb holder moves said second cantilevered portion away from said first cantilevered portion so that said first and second cantilevered portions lose electrical contact whereby electrical current flows from said first and second electrical terminals through said first and second Dumet wires and thence through said filament wherein said first cantilevered portion has a first thickness and said second cantilevered portion has a second thickness and wherein said first thickness is greater than said second thickness;

wherein said second cantilevered portion is attached to said second electrical terminal so that, when said second cantilevered portion pivots toward or away from said first cantilevered portion, said first and second teeth are urged against each other thereby cleaning said first and second teeth for better electrical contact; and wherein said second cantilevered portion is attached to said second electrical terminal by an offset hinge permitting lateral movement of said second tooth in addition to arcuate movement, said offset hinge permitting said second tooth to cam against said first tooth.

* * * * *